United States Patent [19]

Gardner

[11] 4,006,049

[45] Feb. 1, 1977

[54] PIPE COATING APPARATUS

[76] Inventor: David L. Gardner, Rte. 11, Box 64, Conroe, Tex. 77301

[22] Filed: May 19, 1975

[21] Appl. No.: 578,890

[52] U.S. Cl. ..... 156/195; 156/392; 156/425

[51] Int. Cl.[2] ..... B65H 81/00

[58] Field of Search ..... 156/191, 195, 425, 392, 156/218, 390, 73.6, 187, 428, 429; 118/233, 234, 413–414, 114, DIG. 11, DIG. 13

[56] References Cited

UNITED STATES PATENTS

| | | | |
|---|---|---|---|
| 1,979,656 | 11/1934 | Whitman | 156/425 X |
| 1,983,982 | 12/1934 | Knollenberg | 118/414 X |
| 2,135,208 | 11/1938 | Bray et al. | 118/DIG. 11 |
| 2,291,823 | 8/1942 | Mickelson et al. | 118/233 |
| 2,470,068 | 5/1949 | Contenson | 118/DIG. 11 |
| 2,537,509 | 1/1951 | Camp | 156/73.6 X |
| 2,569,765 | 10/1951 | Kellett et al. | 156/390 X |
| 2,992,627 | 7/1961 | Ring | 118/413 |
| 3,740,291 | 6/1973 | Mallard | 156/195 X |
| 3,817,813 | 6/1974 | Keith et al. | 156/195 X |

FOREIGN PATENTS OR APPLICATIONS

| | | | |
|---|---|---|---|
| 5,702 | 1/1932 | Australia | 156/195 |
| 471,479 | 8/1937 | United Kingdom | 156/195 |

*Primary Examiner*—David A. Simmons

[57] ABSTRACT

A pipe coating apparatus which incorporates a mechanism for placing weight material, typically concrete slurry, on a pipe where the weight material is delivered on top of a conveyor belt. The apparatus includes a vertically aligned housing which receives the weight material and has a slot of adjustable height on one side. A conveyor belt extends between two rollers. One roller is located to the side of the pipe. The second roller is located to the side of the first roller and preferably parallel to and immediately below the axis of the pipe. The pipe is supported by the apparatus and the weight material, concrete in a tacky state, travels with reinforcing mesh along the top of the conveyor belt as it travels endlessly around the two rollers from the slot where the weight material is metered on top of the conveyor and wraps in helical fashion about the pipe as it rotates and moves lengthwise. A coating of specified thickness is applied by the apparatus. A modification enables the conveyor belt to carry the reinforcing mesh and an outer wrap offset laterally from another to lap the adjacent turns of helical wrapping, and a narrow belt rides the conveyor to hold the compressed concrete in position along the helical turn last placed prior to covering by an offset.

21 Claims, 4 Drawing Figures

PIPE COATING APPARATUS

RELATED APPLICATIONS

This application is assigned to the common assignee of application Ser. No. 439,322, filed Feb. 4, 1974.

BACKGROUND OF THE INVENTION

As mentioned in the related disclosure, weight material, when applied to a pipe, aids the pipe in sinking when the pipe is installed at offshore locations, under rivers, swamps, and the like. The weight material is preferably applied to the pipe with relatively uniform thickness and density. The apparatus of the present invention is particularly adapted to apply weight material which is uniform in thickness and density. For a given installation, it is often necessary to vary the total weight of material on a pipe. It is sometimes necessary to vary the density because density is often related to the compressive strength of the concrete. For instance, if it is to be exposed to rough handling, the strength which is acquired must be fairly uniform. The present invention is particularly advantageous in that the conveyor provides a substantial amount of smoothing. Smoothing is achieved internally of the slurry and on the surface. When the slurry is delivered to the apparatus, it is dumped through a housing from a mixing source typically conveyed by a conveyor, screw transfer machine, or the like, and may entrap air bubbles. The viscous nature of the slurry normally prevents escape of air bubbles. The apparatus of the present invention avoids entrapped air bubbles by placing the slurry on the conveyor belt where it is scraped as it emerges from a slot, thereby eliminating some of the bubbles. It is compressed between a compression roller and the pipe itself which compresses and removes many of the remaining air bubbles. Through this technique, the size and number of the bubbles are substantially reduced, measurably eliminating air voids in the concrete after it has been applied.

In the coating of pipe, the slurry is applied in multiple turns in helical fashion about the pipe. Adjacent turns preferably overlap somewhat. This is desirable as opposed to abutting adjacent turns and running the risk of a weakness in the coating after it has cured at the juncture of adjacent turns. The overlapped turns of coating material provide compression at the region of overlap which turns are adequately comingled to form a unitary coating as opposed to one which has a helical plane of weakness running through it.

The overlapping of adjacent turns of coating material creates a problem which is cured by the alternative embodiment to be described hereinafter. Each turn of coating material incorporates a layer of reinforcing mesh. On the exterior, a weather proofing or outer wrap is applied. The alternative embodiment to be described places the reinforcing mesh in the slurry as it is applied at an offset location. This enables adjacent turns to overlap without bending the reinforcing mesh. It is desirable that the reinforcing mesh in the cured coat of weight material form a concentric cylinder. Adjacent edges of it lap one another, but it is undesirable that the edges be folded under. The same is also true of adjacent turns of the outer or protective wrap. When a first turn is applied, it is not desirable that the next turn be placed over the wrap and folded under. This increases the likelihood of leaks in the outer wrap. The present invention accomodates this problem by aligning the outer wrap, the reinforcing mesh, and the rectangular shaped strip of coating material with offsets so that the coating material is overlapped without distorting the finished shape of the reinforcing mesh and the outer wrap.

SUMMARY OF THE INVENTION

The present invention incorporates many advantageous features. It particularly includes a means whereby a weight material, typically a tacky concrete slurry, is applied in a calculated thickness and calculated density to a pipe with all air bubbles belt therefrom. The apparatus incorporates a vertically directed funnel above a housing. This serves also as a storage hopper. It is preferably generally rectangular, having one wall or side removed. It has a slot at the bottom of that side with an adjustable gate which moves to a selected vertical height whereby the concrete coating material is delivered at a specified thickness. The chute is open at the bottom. It is arranged immediately above a conveyor having a width equal to or greater than the chute. The conveyor belt travels in an endless route, passing over two rollers and travelling between them. One roller is positioned beneath the pipe to be coated and is normally axially aligned. The other roller is parallel to the first and located to the side. The housing which receives the coating material is above the conveyor belt and between the two rollers which support the conveyor belt. The coating material is applied with a reinforcing mesh which passes through an elongate eyelet above the conveyor. The housing is spaced just above the conveyor belot to controllably space the reinforcing mesh which is carried along and parallel with the conveyor belt. The coating material falls onto the top of the mesh and fully surrounds it, and is carried on the conveyor belt. An outer wrap material is selectively incorporated. The materials all travel from the side of the pipe toward the pipe as the conveyor rotates, moving the materials. Air bubbles in the slurry are present as the slurry passes beneath the gate which cuts a portion of the materials from the top, achieving some compression and avoidance of air voids. The materials are compressed against the pipe between the roller and the pipe itself. This assures proper application of the materials and avoidance of most voids in the weight material after it cures.

The alternative embodiment of the present invention incorporates means for laterally offsetting the outer wrap, the reinforcing mesh, and the slurry so that adjacent turns of the slurry overlap while the outer wrap and the reinforcing mesh are formed concentrically planar about the pipe and are overlapped rather than folded under. In the application of the slurry, this means that one turn is first applied and a marginal edge of it is left uncovered with outer wrap material. This exposed portion of the turn subsequently rotates around, and it is that portion which is overlapped with the next turn of coating material, thereby comingling the two turns and creating a strong junction between them. The margin of exposed coating material is compacted by an alternative conveyor which is relatively narrow. It need only be as wide as or slightly wider than the exposed margin, perhaps two or three inches in comparison with the main conveyor which can be any width desired. The secondary conveyor traverses the same path as does the top portion of the conveyor. It travels part way around the pipe to a pulley and is then returned to other pulleys back to the point of beginning for the endless conveyor.

The alternative embodiment further discloses a fixed pivotal mounting enabling it to rotate the conveyor belt, the hopper system, and all of the apparatus so as to vary the helical lead of the coating material applied to the pipe.

DESCRIPTION OF THE PREFERRED EMBODIMENT

Figure 1:
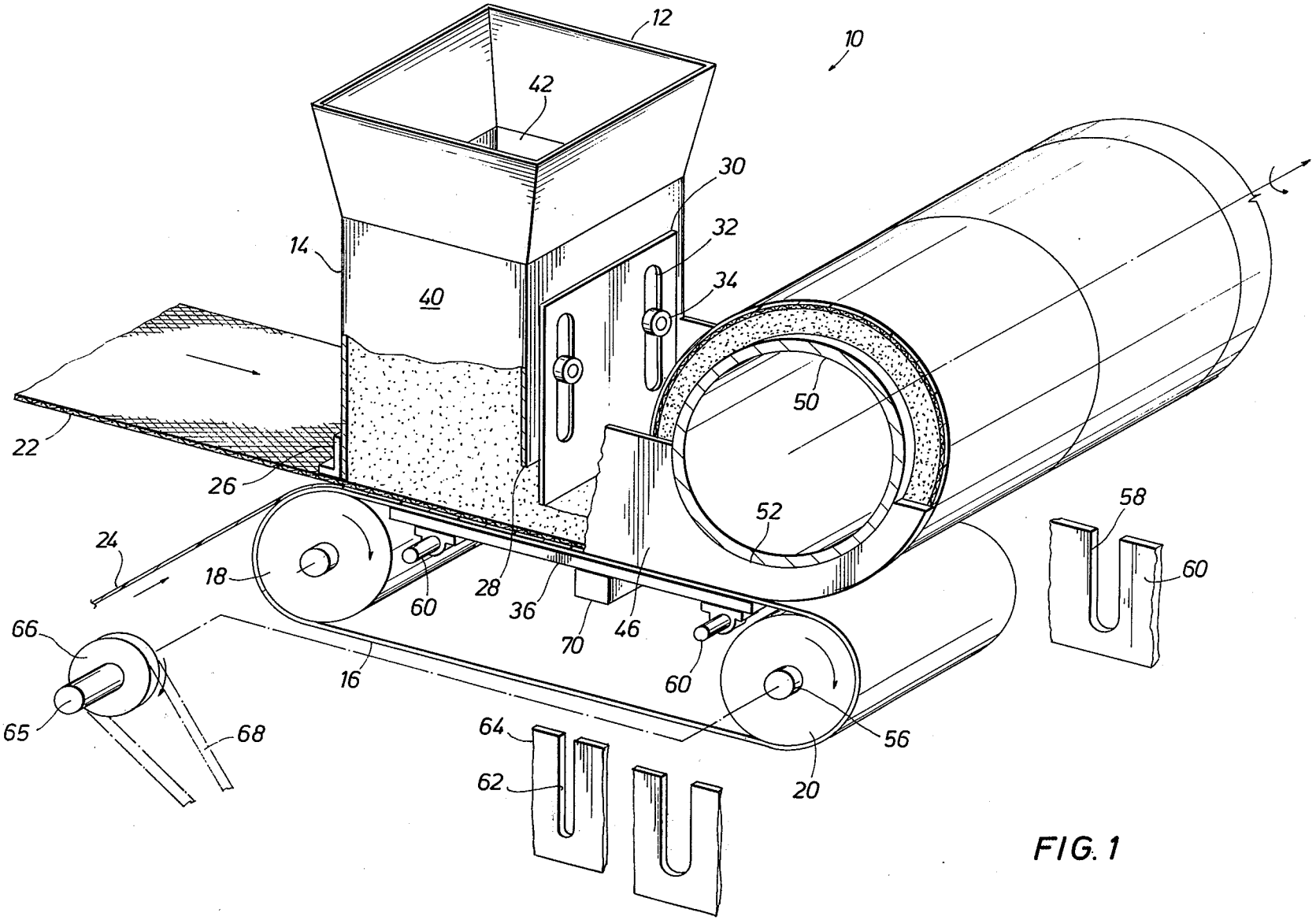
FIG. 1 is a perspective view of the applicator apparatus taught in accordance with the present invention.

The apparatus of the present invention is intended to be used with pipe coating apparatus such as that shown in the related application. Pipe coating apparatus customarily includes means for handling the pipe as it travels inbound, and means for handling it as it travels outbound. The pipe is moved axially and is simultaneously rotated. The pipe increases in diameter and weight after the coating material is placed on it. The outbound apparatus must handle larger diameter pipe with more weight. The pipe handling apparatus which cooperates with the present invention and provides supporting structure for the apparatus shown in the single drawing can readily be the apparatus incorporated by reference.

The present invention is identified at 10 in the drawing. It includes an upwardly facing funnel 12 which opens into a rectangular housing 14. It serves as a temporary storage container and is preferably rectangular, or even square, in cross section. It is preferably open at the bottom. It is arranged immediately above a conveyor belt 16 which travels between a first roller 18 and a second roller 20. The rollers are preferably equal in length and diameter, although it is not required that they be matching in these dimensions. The conveyor belt 16 is an endless belt travelling in a clockwise direction as viewed in the drawing. The conveyor 16 is preferably a rubber belt or the like. The conveyor 16 has a width equal to or greater than the width of the housing 14. This is to enable the conveyor 16 to close the bottom of the housing 14. The conveyor 16 is positioned immediately below the bottom open end of the housing 14 to define a relatively narrow gap. In addition an elongate eyelet (in the form shown in FIG. 4) is located above the gap. The slot enables a reinforcing mesh 22 to be introduced through the eyelet between the belt 16 and the housing 14. The narrow gap receives an outer wrap material 24. The reinforcing mesh and the outer wrap 24 are carried at controlled vertical heights on the conveyor belt somewhat in a sandwich arrangement. The mesh is preferably equal in width to the housing 14 while the outer wrap 24 is wider. This enables the wrap material to receive the coating material thereon as will be described.

The housing 14 has a structural reinforcing frame member 26 at its lower edge to maintain rigidity and structural integrity. It serves as a guide directing the reinforcing mesh 22 and the outer wrap material 24 to a point above the conveyor but below the housing 14. The members 22 and 24 are preferably obtained from commercially known sources and are typially spooled in lengths of several hundred or several thousand feet. They can be obtained in multiple widths. The reinforcing mesh is routinely obtained with a selvage wire along one or both edges. The mesh is sometimes called chicken wire, although this nomenclature is not fully descriptive of the screen wire.

The housing 14 receives and stores a substantial quantity of coating material to smooth the supply. As will be noted, the conveyor 16 travels from left to right, picking up the coating material and carrying it to the right. The amount which is dispensed is selectively controlled. The lower edge 28 of the wall of the housing 14 faces the pipe. The gap between the conveyor 16 and the lower edge 28 is rather wide. The gap is selectively controlled by adjustably positioning the gate 30 to close the gap or slot. The gate 30 is selectively locked in position by means of adjustable bolts joined to the housing 14 which protrude into slots 32 in the gate 30. The bolts are engaged with nuts 34 to clamp the gate 30 at a selected height. This controls the thickness of material which is placed on the conveyor 16 for subsequent application to the pipe.

The conveyor 16 hangs limp on the lower side of the rollers 18 and 20. It carries substantial weight beneath the housing 14. A support plate 36 is located below the top run of the conveyor belt 16. It is located between the rollers 18 and 20. The left hand edge of the reinforcing plate 36 is immediately adjacent a point where the belt 16 tangently leaves the top of the roller 18. It extends fully across the space between the rollers 18 and 20 and almost to the point where the conveyor belt 16 tangently contacts the top of the roller 20. This prevents sag of the belt in the middle where it carries substantial weight. The belt is able to slide smoothly on top of the plate 36 and it carries with it the reinforcing mesh 22, the outer wrap material 24, and the unset slurry material of prescribed thickness.

The housing 14 is formed of facing side walls 40 and 42 which are vertically arranged. They define the maximum width of the coating material to be applied. Their width is preferably equal to or less than the width of the conveyor 16. The width may be several centimeters more narrow to enable the conveyor belt to overlap the reinforcing mesh 22. It may be desirable in some instances to overlap the reinforcing mesh between adjacent turns of the helical coating material applied in a spiralling pattern along the pipe. This is permissable, and can be achieved with no particular problem other than obtaining materials of the desired width. The facing side walls 40 and 42 extend vertically and parallel to one another. They define the housing and further limit lateral movement of the wet and flowing weight materials. The side wall 40 includes a parallel extended wall portion 46 which extends along the conveyor 16 and above the plate 36 to the near vicinity of the pipe to be coated, the pipe itself being identified at 50. The pipe 50 approximately matches a contoured edge 52 on the plate 46 which enables the pipe 50 to be positioned snugly near the guide plate 46. The plate 46 prevents loss of coating material to the side. The plate 46 approximately conforms to the pipe 50, although it need not be contacted against it. A slot in the range of one to three centimeters between the contoured edge 52 and the pipe 50 is permissible, for example. With this in view, the slurry material is captured so that it must be carried to a point where it is applied to the pipe 50.

Similar guide plates are positioned opposite sides of the conveyor 16 and they are similarly constructed, having similar curved or contoured edges like that shown at 52. When the apparatus is to be used for coating pipe of different sizes, it may be necessary to reshape the plate 46 or to install a substitute plate having a different radius of curvature at 52. The roller 20 is positioned a specified distance from the pipe 50. The roller 20 cooperates with the pipe to specify the thickness to which the coating material is to be applied. This is adjustable over a desired range. The side or guide plate 46 has a vertical dimension which enables the roller 20 and the pipe 50 to be positioned relatively close together or spaced far apart. This vertical dimension may also have to be varied to obtain rather thin coating on the pipe 50. Variations in this height and radius of curvature 52 can be readily achieved by substituting guide plates 46 which differ at the respective dimensions mentioned. It is not essential that the guide plate extend all the way around, because the cohesive nature of the slurry keeps it jelled and in contact with the adjacent turn.

In application, the pipe 50 is rotated and each turn of the helix of materials which are applied thereto shoulders against the previously applied helical turn. Because of this virtue, it is not necessary for the conveyor 16 to have guide plates 46 on both sides to extend perhaps as much as 180° around the pipe. The multiple turns of coating material applied to a single joint of pipe requires that each turn shoulder against and abuts the previously applied turn. Only one side is unsupported and this lasts only momentarily during the first turn until the pipe has been rotated for a second turn where the adjacent layer of material is applied to it. The apparatus for applying coating material is preferably adjustable in spacing from the pipe 50. The pipe 50 is supported a specified distance above the roller 20 without regard to the diameter of the pipe. The vertical spacing is fixed for a selected size of the pipe. It may be desirable to adjust this thickness to apply a different thickness of coating material to the pipe. To accomplish this, the guide plate 46 any require substitution to change the vertical dimension of the contoured encircling edge 52. Further, the roller 20 is supported on a shaft 56 which extends at both ends of the roller 20 and is received in a slot 58 of a support plate 60 (one at each end) for purposes of alignment. The shaft 20 is locked in position in the slot 58 by means of nuts which thread on the ends of the shaft. The roller 20 can either free-wheel on the shaft 56 by means of bearing assemblies preferably placed at least at each end of the roller 20, or it can be powered.

The plate 36 preferably moves upwardly and downwardly also and is preferably supported by a shaft 60 which extends into a similar slot 62 in a support plate 64. The support plate 64 aligns the shaft 60 so that it can be securely held in direct alignment with the remainder of the apparatus while being raised and lowered. The shaft 60 again is preferably locked by placing threaded bolts on both sides of the plate 64 with appropriate lock washers which secure the shaft at a specified elevation relative to the slot 62 and secure the plate 36 at a specified elevation. A similar shaft is preferably mounted on the lower side at the left end of the plate 36 fairly near the roller 18. Through this arrangement, the two ends of the plate 36 can be raised and lowered, thereby positioning the plate below the conveyor belt 16 to adjust the height of the belt 16 relative to the pipe 50 and vary the thickness of the coating material applied to the pipe 50. In normal use of the apparatus, the roller 20 is moved upwardly and downwardly jointly with the plate 36. It is preferable to maintain the top surface of the plate 36 approximately on a tangent line between the rollers 18 and 20.

The shaft 65 connects with the roller 20. The roller 20 can be driven. The shaft 65 supports a sprocket gear or pulley 66 which is engaged with a chain drive or belt 68 which extends to a controllable speed prime mover, not shown. This enables rotation of the roller 20 at a specified rate of speed to control the speed at which the material is applied to the pipe 50. The reinforcing mesh 22 is pulled toward the pipe 50 by either of two power sources. The first source is rotation imparted to the pipe itself. In the referenced disclosure, the pipe is urged axially and simultaneously rotated through the equipment. The first turn of the coating material which is applied in a helix along the pipe is anchored to the pipe using known techniques to fasten the reinforcing mesh. After the first turn has been completed, the reinforcing mesh 22 (being fixed to the pipe by adherence) is drawn through the equipment to encircle the pipe. This continues as the pipe rotates and traverses the equipment. In this arrangement, the conveyor belt 16 may readily free-wheel, carrying the weight of the materials which are applied to the pipe. Alternatively, the roller 20 may be powered through the apparatus described above. A variable control prime mover is preferably used so that the conveyor 16 travels at a controlled rate which is adjustable to approximately match the rate at which the reinforcing mesh 22 is drawn through the equipment. The mesh 22 is preferably advanced on the belt in a non-skid fashion. Preferably the belt carries the bulk of the weight to avoid undue pulling on the mesh. A vibrator mechanism 70 is attached to the support plate 36. It is preferably a multiple or variable speed vibrator mechanism which imparts vibration to the concrete slurry. This aids in removal of bubbles and provides an improved uniformity to the coating material applied to the pipe. The frequency and amplitude may be varied to vary the effect on the weight material dependent on a variety of circumstances.

The apparatus has many advantages in operation. The concrete material is accumulated in the housing to a substantial depth, perhaps as much as fifty or one hundred centimeters. It can be supplied evenly or in spurts, as might occur with a batch mixing plant. The housing 14 serves as an accumulator which smooths out the peaks and valleys in the supply rate. The gate 30 is adjusted to some selected height. It might be set at 10 centimeters, for instance. The coating material which passes beneath the gate will have a thickness of about 10 centimeters prior to compression. This thickness is maintained, although it may tend to settle slightly due to the escape of bubbles and collapse of voids in the tacky material as a result of vibrations imparted to the plate 36. The thickness of a coating itself may be a thickness such as 8 centimeters. The coating material is compressed between the roller 20 and the pipe 50. The reinforcing mesh 22 is forced into the tacky concrete slurry and imbeds permanently therein, providing structural strength and integrity to the concrete cured on the pipe. The reduction of thickness achieved by compression between the roller 20 and the pipe 50 squeezes the last bubbles from the material and provides a rather uniform or controlled density of coating material. The coating material is thus captured as it approaches a point between the two rollers. Any excess coating material is squeezed to the left but is continually fed back to the right as viewed in the drawing so that it is applied to the exterior of the pipe. As it is squeezed down on compression between the two rollers, it achieves a desired thickness as a result of the compression and has a uniform density. The outer wrap material 24 moves with the reinforcing mesh 22 and provides exterior waterproofing membrane around the coated pipe.

Figure 2:
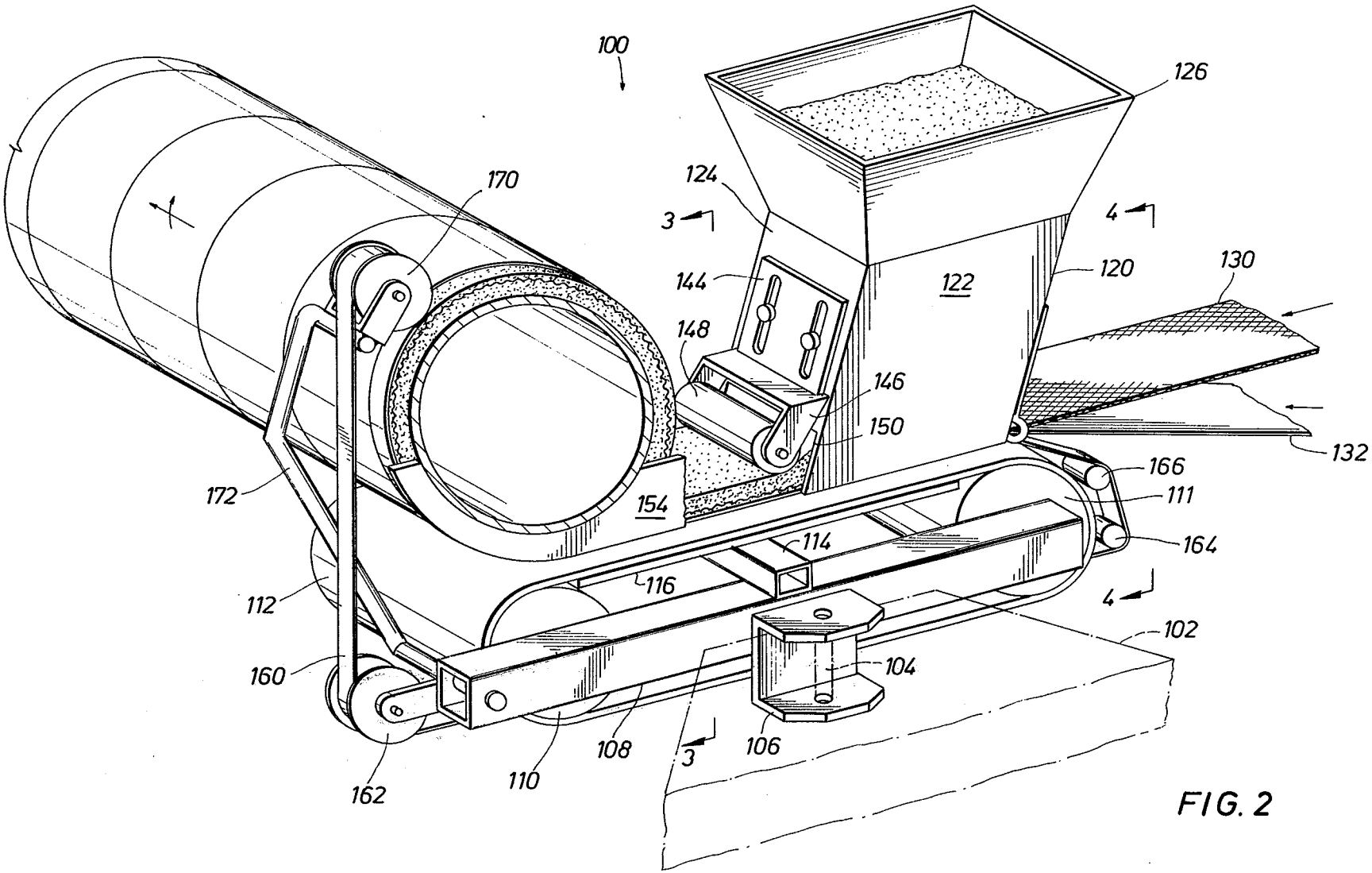
FIG. 2 is a perspective view of an alternative applicator device which is pivotally mounted to rotate as a unit and which illustrates a means incorporating a secondary conveyor which temporarily holds and compacts the margin of each turn of material applied to the pipe.

FIG. 2 shows an alternative embodiment 100. It is supported on a base 102 which is positioned appropriately in line with a conveyor of the sort mentioned in the referenced application. The base 102 supports a threaded shaft 104. The shaft 104 is received through a pair of openings in a rotatable pivotal connection 106. The pivotal connection 106 is attached to a generally horizontal beam 108. The beam supports the apparatus shown in FIG. 2.

The beam supports suitable horizontal shafts (not shown) which support rollers 110 and 111. The rollers support and align an endless belt conveyor 112. It is preferably quite wide in the same manner as the conveyor shown in FIG. 1. The beam 108 supports an additional beam 114. The beam 114 passes beneath the conveyor and supports a plate 116 parallel to the conveyor which prevents the conveyor from drooping or sagging between rollers. The plate 114 is fixed in height vertically relative to the conveyor to provide consistent support.

The beam 108 supports (by means broken away for sake of clarity) the vertically directed generally rectangular housing 120. The housing is formed of four walls, including walls 122 and 124. They extend upwardly to a funnel 126. Concrete is delivered in a viscous state into the funnel and accumulates therein. The housing is hollow at the interior and has an open bottom which terminates at the conveyor belt.

Figure 4:
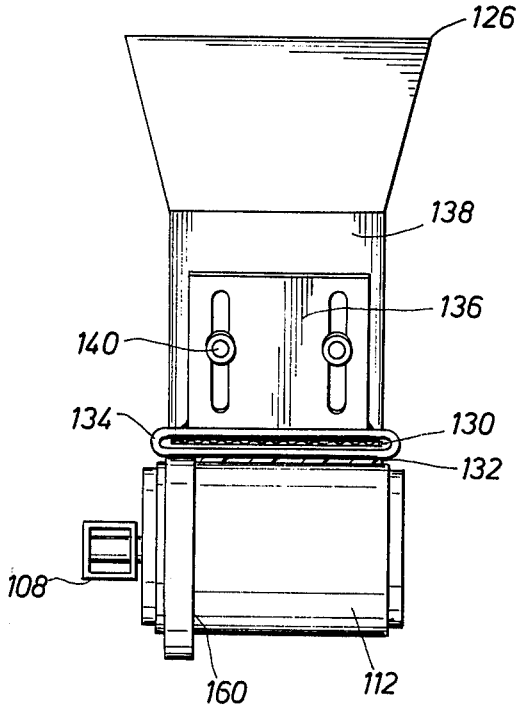

The housing aligns the layer of viscous coating material which is shaped into a generally rectangular cross section before application and aligns it with the reinforcing mesh 130 and the outer wrap 132. As shown in FIG. 4, the outer wrap 130 is shown passing though an eyelet 134. The eyelet is attached to a plate 136 which is slidably attached to an end wall 138 of the housing. The plate 136 is adjustable upwardly and downwardly. It is moved by operation of bolts 140 which are tightened and loosened. They clamp the plate 136 at selected heights in vertically arranged parallel slots shown in FIG. 4. The movement upwardly and downwardly of the plate 136 adjusts the eyelet 134 and varies the height of the reinforcing mesh in the rectangular ribbon of coating material moved from the housing on top of the conveyor 112. The outer wrap 132 is free to move laterally of the reinforcing mesh 130. More will be noted concerning this hereinafter.

Returning to FIG. 2, the wall 124 of the housing supports a gate or plate 144. It is adjustable upwardly and downwardly relative to the housing. It is locked in position by means of bolts which extend through slots. The gate 144 supports a pair of protruding tabs 146 which hold and position a roller 148. The roller is mounted on a shaft for free-wheeling contact against the top of the ribbon of coating material carried on the conveyor belt. The wall 124 has an opening 150 cut in it at its lower bottom edge. The conveyor emerges through the opening 150. The opening contours the volume of slurry in the housing and a generally rectangular ribbon is carried though the opening 150 on the conveyor. The width is determined by the width of the opening 150. The height is determined by the maximum height of the opening 150 but is further limited by the position of the roller 148. The roller 148 is a device which regulates the thickness of the ribbon applied to the pipe and rolls against the surface of the ribbon of the material tending to squeeze a portion back toward the housing and further tending to squeeze air bubbles from the slurry material. The roller 148 serves as a means which levels and smooths the top face of the ribbon of viscous material and determines the thickness thereof. The reinforcing mesh is embedded in the ribbon at a height determined by the setting of the eyelet 134. As the eyelet is raised, the reinforcing mesh is raised relatively in the ribbon as it emerges from the housing. The reinforcing mesh has openings permitting cementatious slurry to fall through the openings and collect above the below the reinforcing mesh, thereby surrounding the reinforcing mesh and causing it to find support at the controlled elevation.

A side plate 154 or side defining means is supported parallel to and by the housing, and the plate is shown broken away to clarify details of construction. The plate 154 has a curved profile as shown in FIG. 1 to encircle the pipe and abut one edge of the turn of coating material applied to the pipe. It provides lateral support. The coating material is compacted by the roller 110 in conjunction with the conveyor 112 and the support plate 116. It is compacted against the pipe. Compression during application provides ample strength in the completed coating. Dimensional control of the coating material is achieved by the constraint imposed by the conveyor on the bottom and the outer wrap material 132. The outer wrap material constrains the wet, somewhat flowable material after it has been compacted. The flowable material is constrained or confined by the side wall 154 on one side and is otherwise laterally supported on the opposite edge by the turns previously applied. On the first turn applied at the end of a pipe, the unsupported edge will tend to flow laterally, but it can be supported by temporarily taping a ring of any disposable waste material such as surplus outer wrap material and the like.

Figure 3:
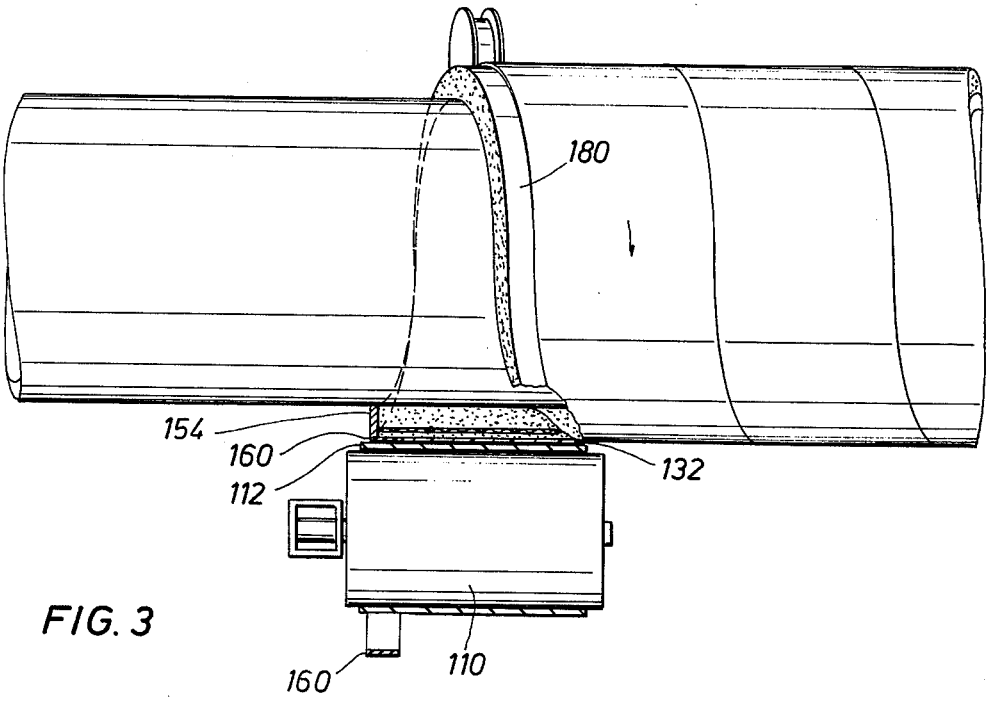
FIG. 3 is a view along the line 3—3 of FIG. 2 showing the marginal turn which is laterally offset from the reinforcing mesh and the outer wrap material; and, FIG. 4 is a sectional view along the line 4—4 showing the relationship of the reinforcing mesh, the main conveyor, and the secondary conveyor.

The present invention shown in FIG. 2 further incorporates a second conveyor 160 or face defining means. It passes over a roller 162 to be guided in the same direction as the conveyor 112. It travels from the roller 162 toward another roller 164. It travels at a slightly different rate on the bottom side of the equipment and is preferably spaced apart from the conveyor 112 at the bottom. This slightly different rate results from the differences in radius on traversing the curves in the two routes of the conveyors. The conveyor 160 travels around the roller 164 and to another roller 166 which aligns the conveyor 160 with the top surface of the conveyor 112. The conveyor 160 travels along the top of the conveyor 112. It provides a lateral edge abutting the outer wrap 132. It enables the outer wrap to be offset somewhat. The outer wrap is offset to enable it to expose the margin of the freshly applied ribbon of coating material. This will be described in reference to FIG. 3.

The conveyor 160 travels along the top of the conveyor 112. The conveyor 112 provides the motive force by frictional engagement of the two so that they travel at the same linear rate when contacted. The conveyor 160 passes beneath the pipe. A roller 170 supported on a movable arm 172 positions the conveyor 160 so that the conveyor supports the edge-most margin of the freshly applied coating material for about 90 to 135 degrees of rotation. This avoids flaking away. It provides support with slight compression so that the cementatious material is compressed and does not tend to flake away even though it does not have an outer wrap around it at this juncture. The outer wrap is displaced toward the coated end of the pipe. It is moved away from the uncoated end of the pipe to enable the next turn of coating material to be applied to the pipe with an overlap, thereby permitting the adjacent turns of the coating material to be comingled without folding under the outer wrap. The width of overlap should not exceed the exposed margin (previously defined as the portion of the turn which is not covered by outer wrap on the first turn). The margin is, however, covered by the next turn by lateral displacement of the outer wrap so that the second turn covers the margin of the first turn while the margin of the second turn is covered by the third turn.

The arm 172 is pivotally supported on the beam 108. It rotates to the upright position, causing the secondary conveyor 160 to wrap partly around the pipe during application. It rotates to a generally horizontal position, moving to an out-of-the-way location in preparation for placing a pipe on the apparatus. The pipe is driven linearly and rotated in the direction of the arrows shown in FIG. 2. This rotation and linear movement is imparted by the pipe supporting and conveyor apparatus shown in the referenced application. The apparatus provides its own motive force. It is not absolutely necessary to power the conveyor 112 although it is normally desirable to avoid excessive stretching of the mesh. It rotates at the same surface speed determined by the pipe. The diameter of the pipe then becomes immaterial to the speed of application, and requires no significant apparatus change other than alteration of the profile of the side plate 154 and strengthening of the pipe handling gear as the weight of the pipe and coating increases. The linear speed of the conveyor 112 is matched by the linear speed of the conveyor 160 and they both travel at the same surface or linear speed of the pipe.

Several turns are wrapped around the pipe in helical fashion. The splicing or overlay of the reinforcing mesh 130 should be considered. The reinforcing mesh is fairly accurately vertically centered in the ribbon of reinforcing material. At the edges, adjacent turns of reinforcing material are overlapped and are forced together. The reinforcing mesh has holes in it. The cementious material flows through the holes to enable the overlap to be achieved. The reinforcing mesh is supported generally in a concentric and planar relationship to the pipe during application and even where adjacent turns are crushed together at their edges, sufficient flow through the reinforcing members enables the reinforcing mesh to remain relatively fixed without deflecting along its edges. The adjacent turns of slurry comingle and increase in strength at the abutting edges of the applied coating material.

The outer wrap 132 is offset measurably. This exposes the margin on one edge of the freshly applied turn to enable it to be comingled with the next turn. In like manner, the opposite edge of the outer wrap 130 laps over the prior turn. Lapping over protects the previous turn and covers the margin of the previous turn, thereby covering the entirety of the pipe. This fact is brought out more clearly on viewing FIG. 3. The margin is shown at 180. The outer wrap 132 is shown laterally displaced to the right of FIG. 3. It is abutted against the secondary conveyor 160 which replaces the outer wrap momentarily and for a portion of the turn applied to the pipe. The outer wrap 132 thus covers over the margin 180 of the previous turn. The margin 180 is left so that the two adjacent turns are crushed together with the viscous material flowing sufficiently to enable a smooth joint to be made. There is no lump or mound formed at the point of overlap. The roller 110 and conveyor 112 are sufficiently wide to crush the two turns together and form a smooth outer surface. Thus it will be observed in FIG. 3 that the turn then being applied is supported on its outer face by the conveyor and the roller and is laterally supported on its left and right. This enables good adherence to the pipe, consistency and coating density, and further causes the freshly applied material to adhere, thereby making handling of the freshly coated pipe much easier. The reinforcing mesh is readily repositioned in the coating material. The eyelet 134 shown in FIG. 4 is raised to bring the mesh closer to the pipe, and can be lowered to be near the surface.

The foregoing is believed to fully and adequately describe operation of the embodiment 100. It can be adjusted in location as a unit by rotation about the shaft 104. This adjusts the lead angle of the helical turns applied to the pipe. The entire apparatus can be raised and lowered by adjusting the location of the connective flange 106 on the mounting shaft 104. When it is lowered or raised, it enables a greater thickness of coating material to be applied. This is particularly true since the pipe is supported at a fixed elevation relative to the conveyor system, which can be conveniently adapted from the disclosed conveyor system in the referenced application. The apparatus can be used to control the precise location of the reinforcing mesh. This enables the mesh to provide optimum support to the coating material after it has been applied.

The entire apparatus can be positioned with the roller located precisely below the pipe or offset. In the absence of a conveyor belt, the roller is aligned with a vertical line which intersects the axis of the pipe and the axis of the roller. Normal operation of the roller type applicator shown in the referenced application applies the helical turn of coating material (with mesh and outer wrap) with the axis of the roller at a slight angle (e.g. 5°) relative to the pipe. This positions the extreme ends of the roller slightly further away from the pipe and hence, the smoothing and compressive performance of the roller leaves a slight ripple on the pipe. This is normally not noticeable and is insignificant. By contrast, the roller and conveyor belt combination is able to smooth the entire width of the helical turn applied to the pipe. Indeed, the roller can be positioned below the pipe and slightly to the side so that compaction is between the pipe and the conveyor belt, not the roller. It is not necessary to locate the roller far to the side; rather, the lateral displacement should be just enough that the conveyor, appropriately supported and hence a planar surface or approximately so, provides full width support beneath the ribbon of material such the helical turn is compressed across its full width. Full width compression forms the smoothest surface. Thus, lateral displacement of the roller from a precise vertically fixed position is acceptable so long as a smoothing compression surface beneath the pipe is included.

Compression of the slurry uses the weight of the pipe. The compressive load on the slurry is sufficient to remove bubbles and smoothly apply the coating. The strength of the cured coating is enhanced.

The coating material is able to include large aggregate. For example, suppose a coating of eight centimeters is to be applied. The aggregated can be as large as the thickness ideally; in practice, the maximum aggregate should not exceed one half the thickness of the coating. This permits two pieces of gravel aggregate to "stack" without creating a bulge in the aggregate. The likelihood of three pieces stacking is so small as to be of no consequence. The competitive "impact" or slinger machinery must use much smaller aggregate to avoid damaging the coating on the pipe.

The foregoing is directed to the preferred embodiments of the present invention. The scope is determined by the claims which follow.

I claim:

1. A method of coating pipe comprising the steps of:

a. placing coating material of specified width on an endless conveyor;

b. compressively and adhesively applying said coating material in helical turns to a rotating pipe which is axially advanced adjacent said endless conveyor; said compressive application causing flow of one edge of said coating material against the last applied turn thereof, whereby said flow is permitted by confining said coating on the opposite edge thereof;

e. and after compressive application, temporarily supporting the face of said coating material in a region adjacent said opposite edge and over a width less than said specified width.

2. The method of claim 1 including the step of placing a reinforcing mesh in the coating material at a specified height which is embedded by turns in the completed coating on the pipe.

3. The method of claim 2 wherein adjacent turns of coating material are overlapped at their abutting edges to overlap the reinforcing mesh.

4. The method of claim 1 including the step of wrapping an external wrap about the coating material on the pipe which is overlapped along adjacent edges.

5. An apparatus for placing concrete on a pipe which comprises:

a roller means positioned approximately below the path of a pipe to be coated and which roller means is adapted to rotate about its axis and is located a specified distance from the pipe;

a second roller means approximately parallel to said first means;

a first belt serving as an endless conveyor belt looped around said first and second roller means which first belt passes around said first roller means and beneath the pipe;

an overhead container means for receiving and dispensing a supply of concrete onto the exposed upper surface of said first belt which container means spans said first belt to deposit a strip of concrete thereon as said first belt moves toward the pipe;

a second belt extending parallel to and in contact with the exposed upper surface of said first belt;

means for positioning an outer wrap material for the pipe parallel to said second belt on said first belt; and said first belt carrying concrete on the upper exposed surface thereof toward the pipe to be coated, said first belt compressively contacting the concrete thereon against the pipe for a specified arc of contact on wrapping around said first roller means, and wherein said second belt contacts the pipe for a larger arc of contact and such contact is against the concrete after compressive application by said first belt.

6. The apparatus of claim 5 wherein said second belt and the outer wrap material abut one another on said first belt and both pass thereon beneath said container means so that concrete is deposited above both, and wherein said first belt contacts the concrete ribbon wrapped around the pipe at less than the full width of the ribbon applied to the pipe and such contact is at the leading edge thereof where the opposite edge thereof is contiguous with a previously coated ribbon of concrete on the pipe.

7. Apparatus for applying a coating of a weight material to the exterior of a pipe, comprising:

pipe handling means for advancing a pipe to be coated along the axis of the pipe and for rotating the pipe about the pipe axis as the pipe is advanced;

a first cylindrical roller positioned approximately below the axis of the pipe and adapted to rotate about a first roller axis spaced a predetermined distance from the exterior surface of the pipe;

a second cylindrical roller positioned laterally from the first roller and adapted to rotate about a second roller axis parallel to the first roller axis;

a conveyor belt extending between the first and second rollers adapted to advance its upper surface toward the first roller in endless fashion;

weight material dispensing means disposed above the conveyor belt and between the first and second rollers for receiving a quantity of weight material and dispensing the weight material over the conveyor belt for application to the exterior surface of the pipe;

first guide means for guiding the weight material on the conveyor belt toward the pipe to wrap around the pipe in helical fashion and which defines a generally rectangular ribbon of weight material having first and second sides on the right and left of an outer face;

means for advancing the conveyor belt toward the pipe to carry the weight material for wrapping around the pipe where one side of the ribbon is placed adjacent to the previously applied helical turns of weight material on the pipe;

the first roller being positioned with respect to the pipe to compress the weight material onto the pipe and to apply the weight material thereover in helical fashion as the pipe is rotated and advanced;

a side defining means contacting the ribbon of weight material to shape and define the second side thereof which side is exposed after application to the pipe for contact against a subsequently applied helically positioned portion of the ribbon of coating material;

the second side and the adjacent outer face defining an edge between them and which second side and outer face come together at an approximately right angle; and face defining means cooperatively arranged with the side defining means for shaping and defining the edge as the ribbon of weight material as applied to the pipe.

8. The apparatus of claim 7 wherein the face defining means comprises a second belt which contacts the ribbon of applied weight material after it has been compressed onto the pipe and which contact occurs at the edge adjacent to the second side.

9. The apparatus of claim 8 wherein the second belt is carried on the conveyor belt in parallel movement and the ribbon of weight material is placed thereon, and the second belt passes beneath the pipe and over the first roller which cooperatively compress the weight material whereupon the conveyor belt wraps around the first roller and pulls away from the applied ribbon of weight material to leave the weight material on the pipe, and the second belt is positioned and placed to contact the applied ribbon of weight material at the edge after compression through at least a part of one revolution of the pipe.

10. The apparatus of claim 9 including a third roller having a bight of the second belt looped therearound, and means for positioning the third roller to guide and position the second belt along the edge of the applied ribbon of weight material after it has passed the first roller.

11. The apparatus of claim 10 including means for supplying an elongate ribbon of a pipe wrapping material to the conveyor belt, and a guide means for directing the pipe wrapping material beneath the weight material dispensing means to receive the weight material thereon and wherein the ribbon of weight material is formed thereon; and further, wherein said first guide means form the first and second sides thereon.

12. The apparatus of claim 8 including a set of rollers which align the second belt for movement in endless fashion along a path including a segment along the conveyor belt overlaid thereagainst and between the pipe and first roller, and returning to the beginning of the its path of movement.

13. The apparatus of claim 12 including a movably mounted roller which is positioned parallel to the axis of the pipe and is movably positioned against the weight material after compression to align the second belt with the edge of the ribbon of weight material.

14. The apparatus of claim 7 wherein the first roller is at an angle relative to the axis of the pipe.

15. The apparatus of claim 7 including a means for supplying an elongate ribbon of reinforcing material to the weight material dispensing means for incorporation into the ribbon of weight material formed on the conveyor belt.

16. The apparatus of claim 15 including a guide means for guiding said reinforcing material.

17. The apparatus of claim 7 wherein said side defining means comprises an elongate metal wall parallel to the conveyor belt and at right angles thereto, and which is formed with a notched profile enabling the side defining means to be positioned beneath the pipe sufficiently close to the pipe to prevent the weight material from extruding between the pipe and the side defining means.

18. The apparatus of claim 17 including an extension appended to the side defining means and terminating at an upright funnel shaped container open at the top thereof to receive weight material therein which comprises the weight dispensing means.

19. The apparatus of claim 18 wherein the side defining means is above the conveyor belt which extends beneath the side defining means by a specified distance, and the side defining means is positioned between the pipe to coated the first roller and has a height limiting the thickness of the helical coating applied to the pipe.

20. The apparatus of claim 15 including a guide means for positioning the reinforcing material offset to the outer wrap material, and the outer wrap material offset to the ribbon of weight material, all of which move parallel to the conveyor belt and second belt approaching the pipe prior to compression.

21. The apparatus of claim 20 including a guide means positioning the outer wrap on the conveyor belt.

* * * * *